US007316311B2

(12) United States Patent
Downing-Perrault et al.

(10) Patent No.: US 7,316,311 B2
(45) Date of Patent: Jan. 8, 2008

(54) RESEALABLE CLEAR FLEXIBLE PACKAGE FOR SHOES

(75) Inventors: Alyssa Downing-Perrault, Brooklyn Center, MN (US); Brianne C. Hartung, Arkansaw, WI (US); Bradley G. Homan, Cottage Grove, MN (US)

(73) Assignee: WISYS Technology Foundation, Madison, WI (US)

( * ) Notice: Subject to any disclaimer, the term of this patent is extended or adjusted under 35 U.S.C. 154(b) by 33 days.

(21) Appl. No.: 11/345,261

(22) Filed: Feb. 1, 2006

(65) Prior Publication Data

US 2006/0168915 A1 Aug. 3, 2006

Related U.S. Application Data

(60) Provisional application No. 60/648,782, filed on Feb. 1, 2005.

(51) Int. Cl.
*B65D 85/18* (2006.01)

(52) U.S. Cl. ..... 206/278; 206/287; 206/466

(58) Field of Classification Search ..... 206/278, 206/287, 232, 466, 459.5, 461, 775–778, 206/806; 211/34; 383/22, 23, 72
See application file for complete search history.

(56) References Cited

U.S. PATENT DOCUMENTS

| | | | | |
|---|---|---|---|---|
| 1,818,030 | A * | 8/1931 | Percy | 383/40 |
| 5,193,675 | A * | 3/1993 | Otis | 206/278 |
| 5,414,975 | A | 5/1995 | Hummel | |
| 5,551,570 | A * | 9/1996 | Shaffer et al. | 206/575 |
| 5,863,576 | A * | 1/1999 | Guarino | 206/778 |
| 6,070,717 | A * | 6/2000 | Philipson et al. | 206/278 |
| 6,234,308 | B1 * | 5/2001 | Saffron et al. | 206/776 |
| 6,405,869 | B1 * | 6/2002 | Whittemore et al. | 206/497 |
| 6,588,594 | B2 * | 7/2003 | Andersen et al. | 206/497 |

* cited by examiner

*Primary Examiner*—Luan K. Bui
(74) *Attorney, Agent, or Firm*—Boyle Fredrickson, S.C.

(57) ABSTRACT

Packaging for shoes provides an open tray fitting within a clear bag. The tray is sized to support the shoes and protect them from crushing while the bag allows the shoes to be viewed by the consumer within the bag.

12 Claims, 2 Drawing Sheets

RESEALABLE CLEAR FLEXIBLE PACKAGE FOR SHOES

CROSS-REFERENCE TO RELATED APPLICATIONS

This application claims the benefit of U.S. Provisional application 60/648,782 filed Feb. 1, 2005, hereby incorporated by reference.

STATEMENT REGARDING FEDERALLY SPONSORED RESEARCH OR DEVELOPMENT

--

BACKGROUND OF THE INVENTION

The present invention relates to packaging for shipping and storing products, and in particular to packaging for shoes.

Shoes are typically packaged and shipped in shoeboxes fabricated of cardboard, with a lid, hinged or sliding into place over one side of the box. The shoes may be wrapped in a paper sheet for protection before being inserted into the shoebox and paper may be stuffed in the shoe to prevent deformation of the shoe inside the box.

At a retail store, the shoeboxes containing the shoes may be stacked on a shelf with labels on the ends of the shoeboxes identifying the type and size of the shoe.

Despite the almost universal adoption of the shoebox for shipping and storing shoes, shoeboxes have some drawbacks. The rigid box can be wasteful of space when the size of the contained shoes is considered. Shoeboxes must be carefully stacked for efficient shipping, and to prevent their contents from becoming dislodged and jumbled. At the retail level, the boxes hide product from direct view, losing the opportunity to promote the produce to the casual consumer and forming a barrier to efficient identification of desired shoes. Retail stores must often dedicate one shoe for display purposes representing a lost sale.

Shoeboxes are also expensive to construct, and because of their bulk and rigid construction, impractical to ship and store.

To address some of these problems, it has been proposed to package shoes in clear bags that may be suspended on hangers or the like. U.S. Pat. No. 5,414,975 describes such a bag that may be used for shipping and displaying shoes. In order to prevent a crushing or deformation of the shoes in transit, inflated bladders are placed within the shoes and pressurized to hold the shoes against crushing.

While such a design provides a number of advantages, the use of the bladders adds complexity and expense to the packaging technique that may limit its adoption in the shoe industry.

SUMMARY OF THE INVENTION

The present invention provides a packaging for shoes that uses a combination of a clear bag fitting around an open tray of stiff material. The bag allows the consumer to see the product without opening the bag while the tray protects the shoes from crushing and damage and keeps them organized. Without the constraint of the bag, the tray may fold flat so that the entire packaging system may be readily shipped to a manufacturing site.

Specifically then, the present invention, provides a tray of stiff material having a bottom surface and at least two opposed upstanding side walls, the upstanding side walls being separated across the bottom surface by a distance to allow the shoes to be placed side by side against the bottom surface, to lie substantially below a plane defined by the upper edges of the side walls. A sealable transparent bag is sized to fit over the shoes and tray so that the shoes remain visible through the bag as supported in the tray.

Thus, it is one object of at least one embodiment of the invention, to provide low-cost packaging for shoes that allows the shoes to be viewed in the package while protecting them and organizing them within the package for proper display.

The upstanding sidewalls may be hinged to opposite sides of the tray so that the tray may be shipped in flattened form with the bag fitting to hold the sidewalls of the tray in upstanding orientation.

Thus, it is another object of at least one embodiment of the invention to provide a packaging system that may be effectively pre-manufactured and shipped.

The bottom surface of the tray may be rectangular, and there may be four upstanding sidewalls, one at each edge of the bottom surface.

It is thus another object of at least one embodiment of the invention to provide a tray that remains open for viewing and yet which provides good protection of the shoes against crushing.

The upstanding sidewalls may include printed labels.

It is another object of at least one embodiment of the invention to allow the consumer to readily determine the specific size of the shoe through the bag.

The bag may be resealable.

It is therefore another object of at least one embodiment of the invention to provide a packaging system that allows the consumer to remove and replace different shoes, to try them on, and/or to use the packaging for storing their shoes in the home.

The bag may include a drawstring for resealably closing one end of the bag.

It is thus another object of at least one embodiment of the invention to provide a simple resealing mechanism.

The packaging system may include a label insertable into the bag on top of the shoes adjacent to the bag wall.

It is thus another object of at least one embodiment of the invention to provide a protected label viewable from the angle that the consumer would view the shoes.

The tray may be corrugated cardboard.

It is thus another object of at least one embodiment of the invention to provide a stiff, low-cost tray material.

These particular objects and advantages may apply to only some embodiments falling within the claims and thus do not define the scope of the invention.

DETAILED DESCRIPTION OF THE PREFERRED EMBODIMENT

Figure 1:
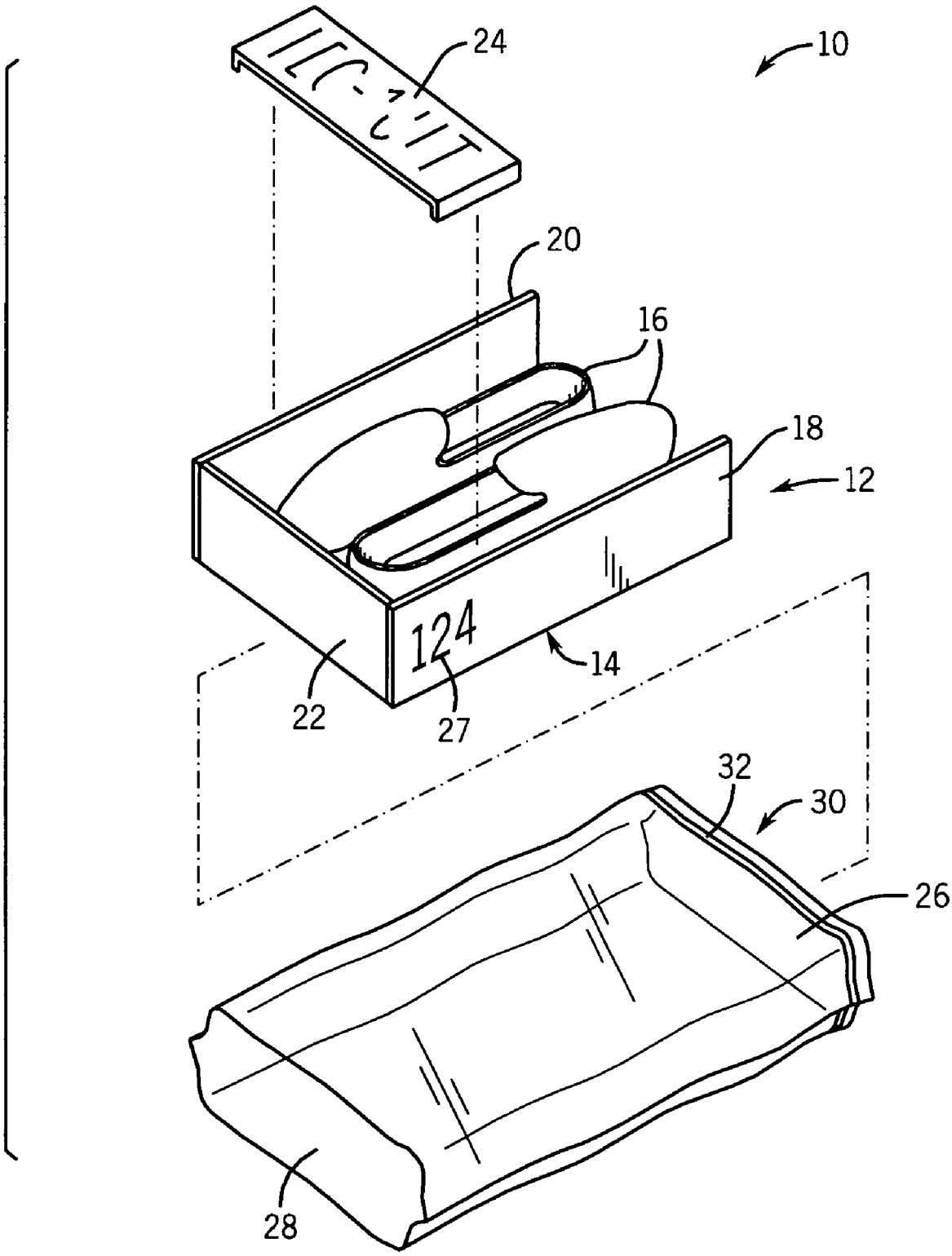
FIG. 1 is an exploded, perspective view of the package of the present invention showing a tray holding shoes and fitting within a resealable clear bag.

Referring now to FIG. 1, a shoe package 10 of the present invention provides a four-sided tray 12 having a generally rectangular bottom panel 14 sized to receive a pair of shoes 16 side by side in heel-to-toe orientation.

Hingeably attached in opposition to two sides of the bottom panel 14 are upstanding sidewalls 18 and 20 extending along the long axis of the rectangular bottom panel 14. At least one hingeable endwall 22 may extend upright from one end of the bottom panel 14 spanning the sidewalls 18 and 20.

Figure 2:
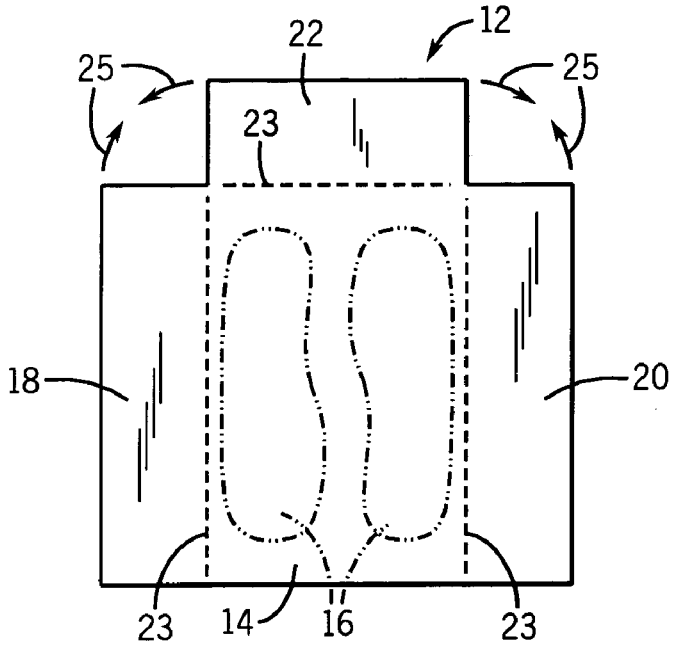
FIG. 2 is a top plan view of the tray of FIG. 1 before being folded for insertion into the bag, showing placement of the shoes thereon.

Referring momentarily to FIG. 2, the tray 12 may be advantageously fabricated from die-cut corrugated cardboard with hinge lines 23 scored or pressed at the connections between bottom panel 14 and each of sidewalls 18, 20 and endwall 22. In this way, the tray 12 may be shipped in flat form with the sidewalls 18, 20 and endwall 22 folded upward as indicated by arrows 25 prior to use.

Referring again to FIG. 1, the height of the sidewalls 18, 20 and endwall 22 is such as to reduce undesired crushing of the shoes 16 and to provide support for the stacking of the shoe packages 10. The upper surface of the tray 12 is open to allow the shoes 16 to be viewed from the top and front. An outer surface of the sidewalls 18, 20 and endwall 22 may include printed labeling 27 identifying particular features of the shoes 16 not evident from their visual inspection such as shoe size. Alternatively or in addition, a placard 24 may span the upper edges of the sidewalls 18 and 20 near the endwall 22 glued to those walls or otherwise fastened or wrapped around the tray 12 or placed loosely on top of the shoes 16. In one embodiment, the placard 24 may be a ring serving to temporarily hold the shoes 16 in place with the sidewalls 18 and 20 extending upwardly.

The tray 12, with the sidewalls 18, 20 and endwall 22 folded up and the shoes 16 placed therein, may fit inside a three-sided clear plastic pouch 26 with the upstanding endwall 22 abutting a base 28 of the pouch 26. The pouch 26 includes an opening 30 allowing the shoes 16 to be easily accessed through the opening 30 without removal of the four-sided tray 12.

Alternatively, the tray 12, as properly folded, may be inserted into the pouch 26 as described, and the shoes 16 inserted as a secondary operation. The flexibility of the pouch 26 allows the shoe package 10 to more closely conform to the volume of the shoes 16, reducing shipping costs.

Figure 3:
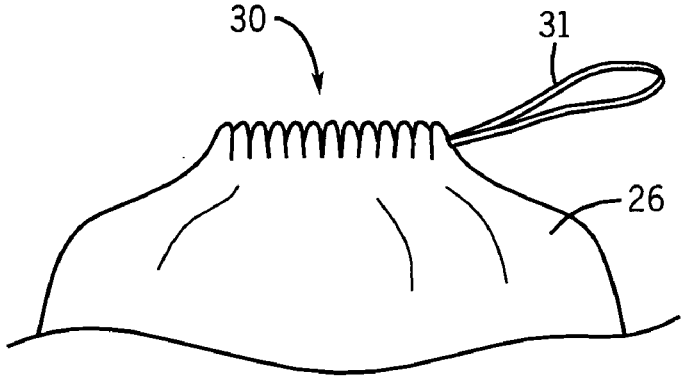
FIG. 3 is a fragmentary plan view of the bag of FIG. 1 as closed with a drawstring.

Referring now to FIG. 3, the pouch 26 may include a drawstring 31 at opening 30 for closing the opening 30 of the pouch 26 and retaining the tray 12 and shoes 16 therein.

Figure 4:
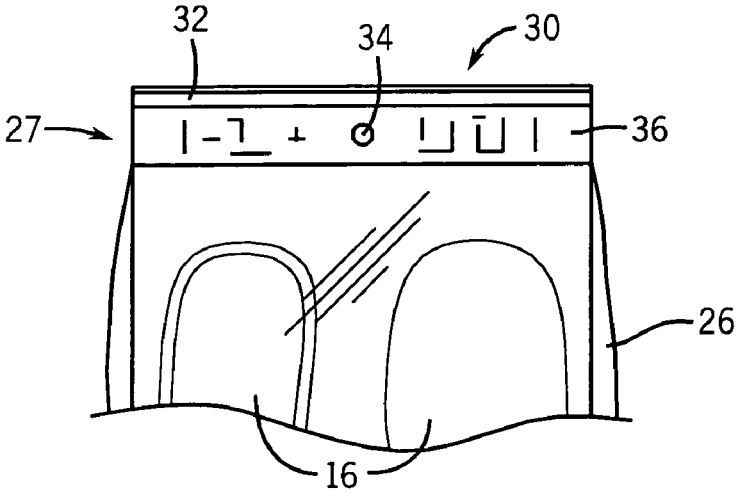
FIG. 4 is a figure similar to that of FIG. 3 showing an alternative closure providing a hangtag on one end of the bag and a molded zipper.

Alternatively, and referring to FIGS. 1 and 4, the pouch 26 may include a molded plastic integral zipper 32 of a type well known in the art allowing the pouch to be opened and resealed as necessary for access to the shoes 16. In this embodiment, the pouch 26 at opening 30 may further include a hanging hole 34 and/or hang tab 36, the latter which may also include a printed legend. These features allow the shoe package 10 be hung on a peg or the like. In addition or alternatively, the pouch 26 may be printed directly.

Unlike empty cardboard shoeboxes, which are difficult to effectively ship for large distances, the components of the present invention may be premanufactured flattened and shipped effectively to a manufacturing site and assembled as described above.

It is specifically intended that the present invention not be limited to the embodiments and illustrations contained herein, but include modified forms of those embodiments including portions of the embodiments and combinations of elements of different embodiments as come within the scope of the following claims.

We claim:

1. In combination:

a pair of shoes; and a shoe carrying package comprising:

a tray of stiff material having a bottom surface substantially equal in length to a length of the pair of shoes and substantially as wide as the pair of shoes when the pair of shoes is placed side by side, heel to toe, and wherein the tray further has only two opposed upstanding sidewalls that are substantially perpendicular to the bottom surface, and a single endwall that is transverse to the two opposed upstanding sidewalls and perpendicular to the bottom surface, wherein the pair of shoes rest against the bottom surface so as to lie substantially below a plane defined by upper edges of the sidewalls and the single endwall and wherein the two opposed upstanding sidewalls and the single endwall remain substantially perpendicular to the bottom surface when the shoes are placed on the bottom surface; and a sealable transparent bag of flexible material sized to fit over the tray in a manner that allows the pair of shoes supported by the tray to remain visible through the bag when the tray is received within the bag.

2. The combination of claim 1 wherein the upstanding sidewalls are hinged to opposite sides of the tray whereby the tray may be shipped in flattened form and wherein the bag holds the opposite sides of the tray to be upstanding.

3. The combination of claim 1 wherein the upstanding sidewalls include printed labels.

4. The combination of claim 1 wherein the bag is resealable.

5. The combination of claim 1 wherein the bag includes a drawstring for resealably closing one end of the bag.

6. The combination of claim 1 wherein the bag includes a hangtag providing a hole receiving a hanger.

7. The combination of claim 1 further including a label insertable into the bag on top of the shoes adjacent to a bag wall.

8. The combination of claim 1 wherein the tray is corrugated cardboard.

9. The combination of claim 1 wherein the single endwall is parallel to an opening formed between the two opposed upstanding sidewalls, the opening allowing insertion and removal of the pair of shoes from the tray and the sealable transparent bag without removal of the tray from the sealable bag.

10. The combination of claim 9 wherein the two opposed upstanding sidewalls and the single endwall are constructed of a material that does not crush when another shoe carrying package of similar design is placed atop the shoe carrying package.

11. The combination of claim 9 wherein each shoe has a length and a width that is less than the length, and wherein the pair of shoes are retained by the tray such that the length of each shoe is parallel to the two opposed upstanding sidewalls.

12. The packaging of claim 1 wherein the upstanding sidewalls and the end wall have a height such that any shoes placed on the tray are entirely below the plane defined by the upper edges of the upstanding sidewalls and the endwall.

* * * * *